US005836402A

United States Patent [19]

Jones

[11] Patent Number: 5,836,402

[45] Date of Patent: Nov. 17, 1998

[54] AUGER-HOLDER

[76] Inventor: Wayne Jones, 456 E. Pond Rd., Nobleboro, Me. 04555

[21] Appl. No.: 511,067

[22] Filed: Aug. 3, 1995

[51] Int. Cl.[6] ..... F21C 11/02

[52] U.S. Cl. ..... 173/185; 173/28; 173/152

[58] Field of Search ..... 173/184, 185, 173/26, 28, 42, 45, 141, 147, 152, 148

[56] References Cited

U.S. PATENT DOCUMENTS

| | | | |
|---|---|---|---|
| 2,639,892 | 5/1953 | Jones | 173/26 |
| 2,723,835 | 11/1955 | Reese . | |
| 2,774,568 | 12/1956 | Jones | 173/26 |
| 3,367,427 | 2/1968 | Baumgardner | 173/185 |
| 3,602,321 | 8/1971 | Kortschaga . | |
| 3,700,045 | 10/1972 | Coontz | 173/26 |
| 3,731,751 | 5/1973 | Rusco . | |
| 4,099,579 | 7/1978 | Stormon | 173/28 |
| 5,363,925 | 11/1994 | Gallagher | 173/185 |

*Primary Examiner*—Scott A. Smith

*Attorney, Agent, or Firm*—Chris A. Caseiro; Thomas L. Bohan

[57] ABSTRACT

An auger-holder designed for transporting, stabilizing, and operating an auger from a vehicle, preferably an all-terrain vehicle (ATV). The auger-holder includes a primary frame, a secondary frame, an attachment device for attaching the primary frame to a vehicle, and a locking mechanism for securing the secondary frame to the primary frame when the auger is not in use. The primary frame includes a structure of vertical and horizontal support members. The secondary frame is adjustably connected to the primary frame for stability and operability of the auger. The auger-holder optionally includes a hinge apparatus for aligning the auger at a range of angles relative to the plane of underlying terrain.

13 Claims, 3 Drawing Sheets

AUGER-HOLDER

BACKGROUND OF THE INVENTION

1. Field of the Invention

The present invention relates to devices for attaching drilling equipment to vehicles. In particular, the present invention relates to an auger holder used in conjunction with an all-terrain vehicle (ATV) to support an auger used to drill holes in ice for the sport of ice fishing. More particularly, the present invention is adapted to be easily mounted on an ATV and operated therefrom without obstructing the normal use of the ATV.

2. Description of the Prior Art

Ice fishing is a popular activity in the colder regions of the world. Ice fishing requires that a hole be drilled through varying thicknesses of ice, which ice may be over several feet thick. The earliest devices for penetrating the ice included using picks, axes, or hand-driven ice augers. More modern devices include various types of powered augers that more easily penetrate the ice. Some of these inventions include hand-held, motor-driven augers. Problems associated with hand-held, power augers include the ease with which they can bind up while drilling through thick ice, leading to the risk of injury, resulting from the auger's maximum torque being applied to its operator. In addition, such a device requires the application of a considerable amount of power by its operator in order to stabilize the auger while it is drilling the hole. Since in cold weather, it is desirable to minimize physical exertions so that the body can focus on keeping warm, it is particularly disadvantageous to have to expend so much energy early in the fishing day just trying to get the hole drilled.

Another problem associated with these hand-held, power augers is that they are fairly large and hence for movement from one location to another requires a person of considerable strength, or two people. This limits the number of people able to take advantage of these powered devices. In particular, people of limited strength cannot use such devices and therefore cannot maximize their fishing time and pleasure.

As the use of power augers has grown, platforms have been created to help stabilize the auger and facilitate moving the auger up and down while drilling through thick ice. This simplifies some aspects of ice fishing, but also adds more problems. Ice fishing often takes place in secluded areas not allow easy access to larger vehicles because of the weight of the vehicle or the difficult terrain in getting to the location. The auger and platform used therewith must therefore be transported by a smaller vehicle, such as an ATV or a snowmobile. Most ATVs and snowmobiles have cargo racks for storing equipment during transportation. Upon arriving at the fishing site, the equipment must be unloaded and assembled in order to drill the hole. It is often desirable to relocate to another area in order to find more fish. Each time a new fishing hole is to be drilled, the equipment must be disassembled, loaded onto the vehicle, and then unloaded and reassembled in order to drill the new hole. This problem is not exclusive to ice fishing. For example, if such a device were used on land for drilling post-holes, the process of unloading, assembling, and stabilizing the auger would waste the time and energy of the operator.

U.S. Pat. No. 3,602,321 (1971, Kortschaga) teaches the use of an auger powered by the clutch pulley of a snowmobile. U.S. Pat. No. 3,731,751 (1973, Rusco) teaches the use of an auger powered by the track of a snowmobile. These devices require added assembly time and energy and can often be dangerous to use due to the open moving parts associated with the assembly and operation of the apparatus. Since ice fishing only takes place in cold climates, thick clothing and gloves are usually needed to keep the individual warm. Such bulky clothing and gloves can get caught in the open moving parts. It is also difficult for someone wearing such clothing to set up devices requiring the manipulation of small parts or to operate a device that requires precise movements. Another problem associated with these devices is that they take up space in the cargo rack and/or they must be secured to the user's vehicle during transportation. This requires time and the expenditure of energy, thus detracting from the safety and enjoyment of ice fishing.

U.S. Pat. No. 2,723,835 (1954, Reese) teaches a frame for supporting a motor-driven ice hole cutter. The frame of the Reese device rests on the top surface of the ice. The frame has prongs that are inserted into the ice in order to further secure the frame while operating the ice cutter. The motor of the cutter is secured to a platform carried by the frame for vertical movement. The Reese device also has a windlass journalled in the frame and has a hoisting rope secured to the platform for raising the platform and the parts associated therewith after the ice hole has been cut.

The Reese device fails to address many of the problems associated with the stabilization, transportation and operation of the auger. While the Reese device may provide more stability than a hand-held auger, the device may still twist or loosen, depending on the vibration and torque exerted when drilling through the ice. The Reese device must be assembled and disassembled each time a new hole is drilled. The device takes up space on the vehicle and likely must be secured during transportation. The operation of the Reese device becomes more difficult because of the setup time required to secure the pins in the ice and the rope-pulley means for retracting the auger from the hole.

Therefore what is needed is an augerholder that can be secured to, transported by, and operated from various types of vehicles, including ATVs and snowmobiles, without the need to disassemble the device at any point. What is further needed is an augerholder that permits full use of the vehicle's cargo rack. What is still further needed is a device that allows an individual to easily raise and lower the auger when drilling a hole. What is still further needed is an auger-holder that is relatively easy to install and operate. Finally, what is needed is an auger-holder that is adjustable to fit various types of vehicles and to be used on various types of terrain.

SUMMARY OF THE INVENTION

It is an object of the present invention to provide an auger-holder that can be secured to and transported by a vehicle. It is another object of the present invention to provide an auger-mounting device that permits the auger to be operated while secured to a vehicle. Yet another object of the present invention is to provide an auger-holder that can be transported by a vehicle without limiting the normal use of the vehicle's cargo rack or requiring supplemental means for securing the device. Another object of the present invention is to provide an auger-holder that will allow a single person to easily retract the auger from the hole after drilling. Yet another object of the present invention is to provide an auger-holder that is relatively easy to install and operate while wearing thick clothing and gloves. Finally, it is an object of the present invention to provide an auger-holder that is adjustable for use with various types of augers on various types of terrain.

The auger-holder of the present invention includes a primary frame, a secondary frame, a locking means for securing the secondary frame in a fixed vertical position relative to the primary frame, and an attachment means for securing the primary frame to the vehicle. The secondary frame includes a means for securing an auger and is connected to the primary frame in a way that permits the auger to be moved up and down in relation to the stationary primary frame. The secondary frame may be secured at various positions on the primary frame. The primary frame includes vertical and horizontal supports and is detachably connected to a vehicle. The primary frame may further include a means for adjusting the angle of the primary frame in relation to the terrain. The mounting device may be used to secure any sort of hole-forming equipment, including, but not limited to, post-hole drills. For that type of auger, the mounting device of the present invention can be adjustable with respect to the terrain so as to accommodate the pitch of a hill in order to align the post holes vertically. Since ice is relatively flat, the adjustable primary frame would not generally be necessary for the ice auger to drill a hole perpendicular to the plane of the ice, but the distinguishing feature may occasionally be useful when pressure ridges cause the ice to become uneven and non-flat.

An obvious advantage of the present invention, especially in cold weather, is the ability to secure the auger to the rear of a vehicle and to drive to any location where a hole is to be drilled and then to drill the hole without any installation of the mounting device or the auger. Another advantage arises because the auger is capable of being operated while attached to the vehicle. No further stabilization of the auger is required, because the vibrational and torque-related forces are countered by the weight of the vehicle. The present invention allows one to secure, transport, and operate an auger using the existing cargo rack for support with little, if any, restriction on rack storage capacity. A further advantage of the present invention is the facility of drilling the hole and retracting the auger from the hole after it has been drilled. This may be accomplished by using assistive means including, but not limited to, a spring-, hydraulic-, gear-, or motor-type mechanism mounted on the primary or secondary frame. Finally, a further advantage is that the present invention may be used with various types of augers and vehicles on various types of terrain. These and other advantages of the present invention will become apparent upon review of the drawings, detailed description of the device, and the appended claims.

DETAILED DESCRIPTION OF THE PREFERRED EMBODIMENT

Figure 1:
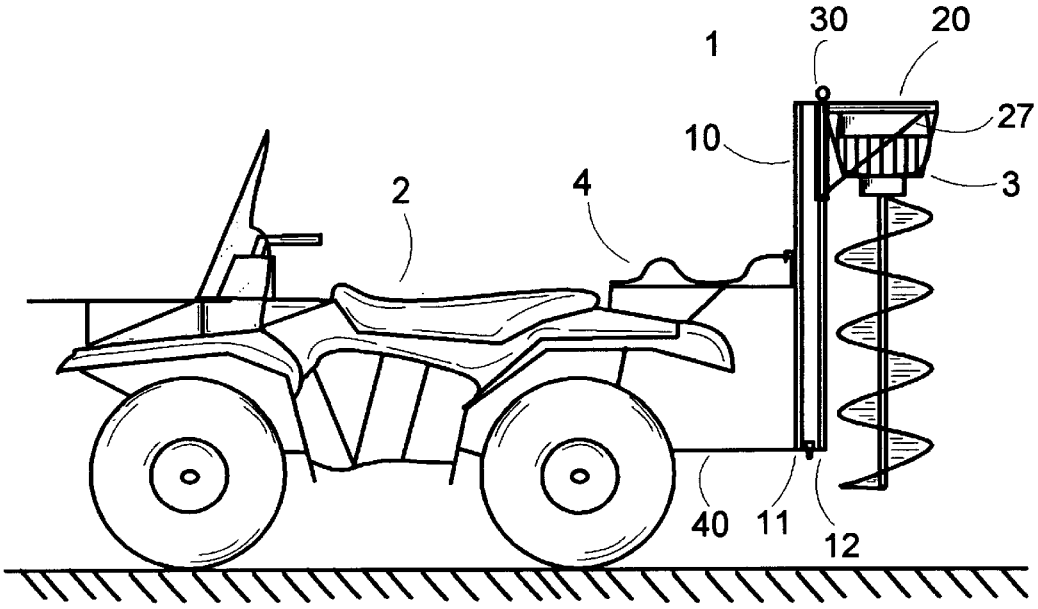
FIG. 1 is a side view of the present invention attached to the rear cargo rack of an ATV with an auger mounted thereon.
Figure 2:
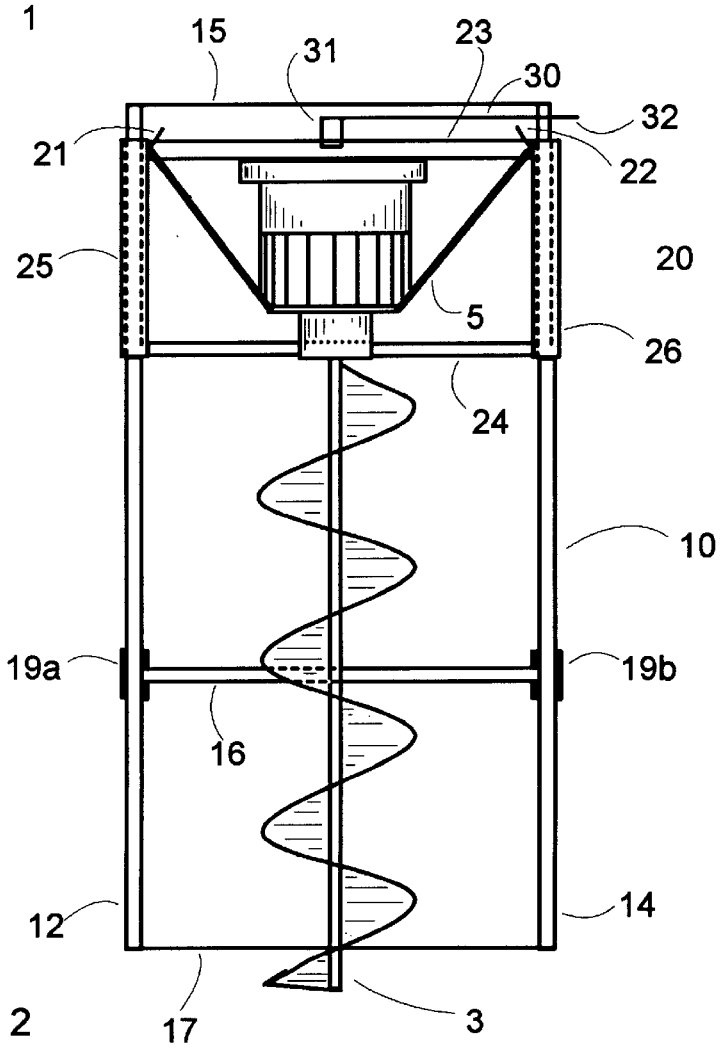
FIG. 2 is a front view of the present invention with an auger mounted thereon.

The preferred embodiment of the present invention is illustrated in FIGS. 1–5*a*. As shown in FIGS. 1–2, an auger-holder 1 includes a primary frame 10, a secondary frame 20 for securing an auger 3, a locking means 30, and an attachment means 40 for securing primary frame 10 to a rack 4 of an all-terrain vehicle (ATV) 2. It is to be understood that the device 1 may be mounted to any vehicle. In the preferred embodiment of the present invention, the auger-holder 1 is formed of aluminum. However, it is to be understood that all or portions of the device 1 may be made from materials such as other metals, plastics (including fiberglass), or the like, having sufficient strength to support the auger 3 and the vibration associated with its use.

The primary frame 10 includes a left rear vertical support 11, a left front vertical support 12, a right front vertical support 14, an upper horizontal support 15, a middle horizontal support 16, and a lower horizontal support 17. It is to be understood that a right rear vertical support is symmetrically positioned in cubical alignment with the left rear vertical support 11 and the right front vertical support 14. The secondary frame 20 includes a left auger arm support 21, a right auger arm support 22, an upper horizontal member 23, a lower horizontal member 24, a left sliding means 25, a right sliding means 26, a left diagonal support 27, and a fastening means 28. It is understood that a right diagonal support is positioned similarly to left diagonal support 27. The locking means 30 preferably includes an engaging means 31, such as a hook, and a lever 32. In the preferred embodiment of the invention, the left sliding means 25 is a section of tubular iron and its crosssection is slightly larger than the cross-section of the vertical support 12 in order to allow the vertical support 12 to easily pass therethrough. The right sliding means 26 is similarly designed. The locking means 30 may be designed in a variety of ways. It may include any of a number of forms of catch-and-release mechanisms such as a releasable ratchet, a locking pin, or the like.

Figure 3:
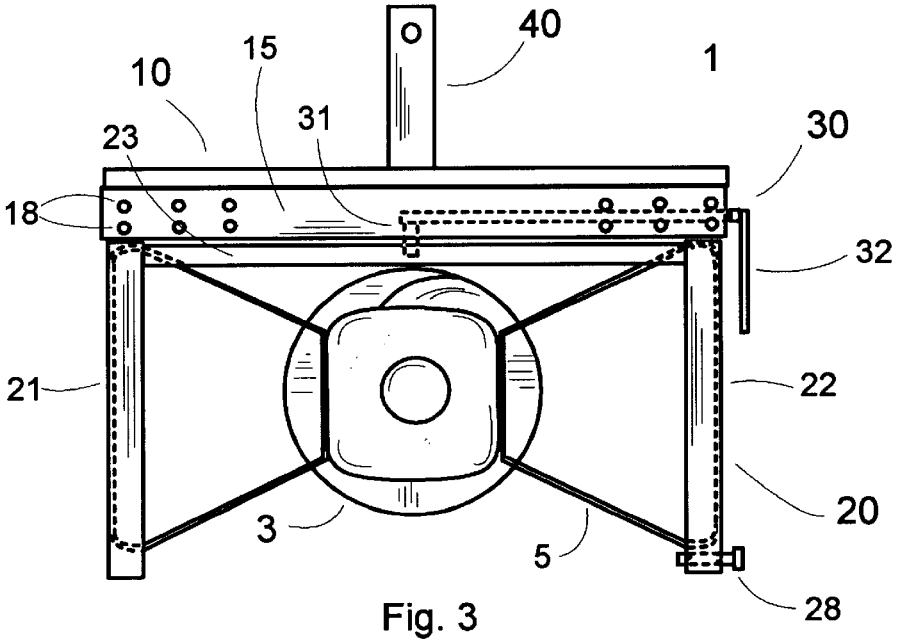
FIG. 3 is a top view of the present invention with an auger mounted thereon.
Figure 4:
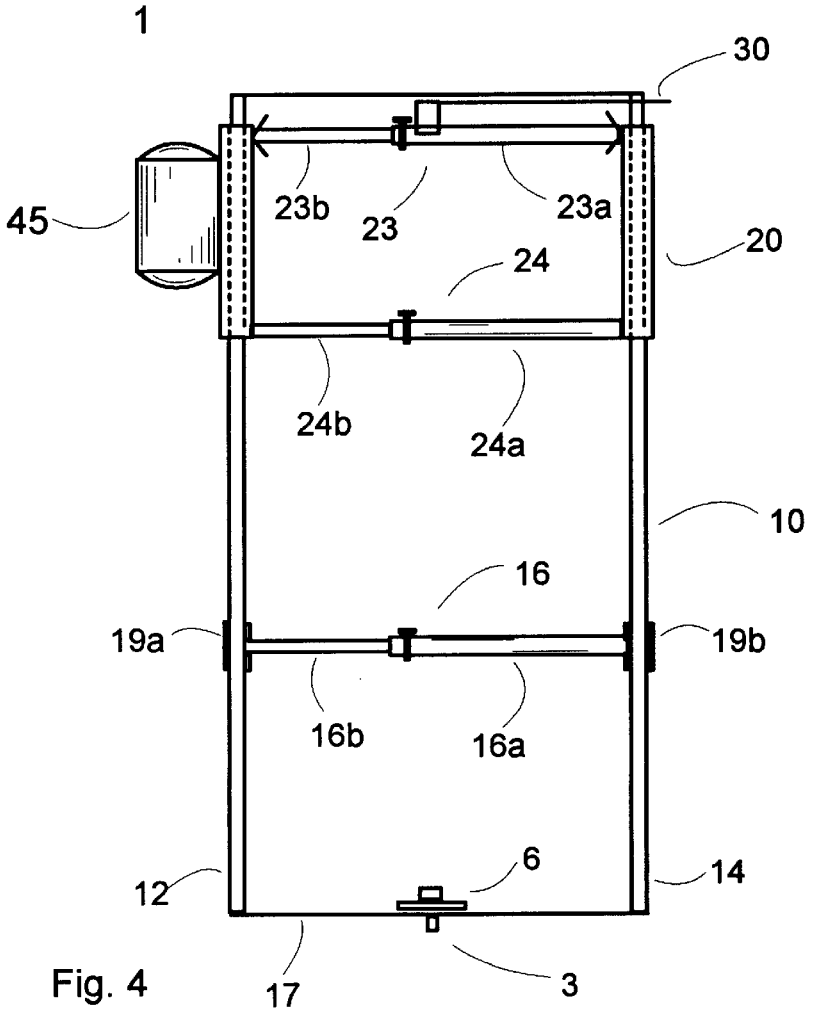
FIG. 4 is a front view of an alternative design including a motor mounted on the primary frame for retracting the auger from the hole and showing horizontal adjustment features.

As illustrated in FIGS. 2–3, the auger 3 is secured to the secondary frame 20 by the left auger arm support 21 and the right auger arm support 22. The left auger arm support 21 and the right auger arm support 22 are formed to receive and secure handle 5 of the auger 3. The fastening means 28 stops handle 5 from sliding out of the right auger arm support 22. The fastening means 28 may be one of a variety of securing devices, including, but not limited to, a threaded bolt, a selflocking pin, and the like. The upper horizontal member 23 is fixed to the left auger arm support 21 and to the right auger arm support 22. The right auger arm support 22 is designed to receive the fastening means 28 by inserting the fastening means 28 through the end thereof. The upper horizontal member 23 and the lower horizontal member 24 may be adjustable in order to accommodate various shapes and sizes of handles. As shown in Fig. 4, a first section 23*a* and a second section 23*b* of upper horizontal member 23 are movable with respect to one another so as to permit width adjustment of the secondary frame 20. Similary, lower horizontal member 24 includes first section 24*a* and second section 24*b* that are movable with respect to one another for such adjustment. Pins extending through sections 23*a,* 24*a,* and 23*b,* 24*b,* lock the adjusted secondary frame 20 in place for receiving augers of virtually any handle dimensions. The upper horizontal member 23 and the lower horizontal member 24 may be channelled, angled, or tubular members. An engaging means 31 is angled or hookshaped and secures the upper horizontal member 23 in close proximity to the upper horizontal support 15. The engaging means 31 is welded or bolted to a lever 32. The lever 32 is hingedly fixed to the upper horizontal support 15 and extends to within reach of the operator of the auger 3. The upper horizontal member 23 is fixed to the upper end of the left sliding means 25 and the upper end of the right sliding means 26. The lower horizontal member 24 is fixed to the lower end of the left sliding means 25 and the lower end of right sliding means 26. The cross-sections of the left sliding means 25 and the right sliding means 26 are tubular, allowing the left front vertical support 12 and the right front vertical support 14, respectively, to pass therethrough. The left diagonal support 27 is welded to the lower horizontal member 24 and to the left auger arm support. It is to be understood that a right diagonal support is positioned similarly to the left diagonal support 27.

As shown in FIGS. 1–3, the upper horizontal support 15, the middle horizontal support 16, and the lower horizontal support 17 are adjustable in width, corresponding with adjustments to the secondary frame 20 in order to accommodate various sizes of augers. Sets of paired holes 18 allow width adjustment of the primary frame 10. The upper horizontal support 15 and the lower horizontal support 17 may be channelled members or flat strips. The vertical supports are attachable to the upper horizontal support 15 and the lower horizontal support 17. The left rear vertical support 11, the left front vertical support 12, the right front vertical support 14, and the right rear vertical support are tubular. Each includes a bolt or pin fixed within the uppermost and lowermost portions thereof which are inserted through the sets of paired holes 18 to secure the primary frame 10.

In an alternative embodiment illustrated in FIG. 4, the horizontal supports 16, 23, and 24, are adjustable to fit various sizes of vehicles and augers. Each support includes an outer portion, such as 16*a,* and an inner portion, such as 16*b.* The outer portion 16*a* has a cross-section sufficiently larger than the cross section of its corresponding inner portion 16*b* to allow the inner portion to be inserted therein. The adjustable portions are secured together by a bolt, pin, or the like. It is also possible to make the vertical supports adjustable in a similar manner.

The secondary frame 20 is adjustably engaged with the left front vertical support 12 and the right front vertical support 14. The middle horizontal support 16 is fixedly attachable to the left rear vertical support 11 by a left rear sliding means 19*a* and to the right rear vertical support by a right rear sliding means 19*b*. The means for securing the rear sliding means 19*a* and 19*b* may be a pin, bolt or the like. The middle horizontal support 16 may be channelled or L-shaped. The middle horizontal support 16 clamps down on the rack 4 to secure the auger-holder 1 to the ATV 2. It is to be understood that various types of vehicle racks or mounts exist and that the middle horizontal support 16 may be adapted to secure the primary frame 10 to such racks or mounts. The auger-holder 1 is further secured to the ATV 2 by the hitch mount 40. The hitch mount 40 is adjustably secured to the lower horizontal support 17 and includes a pin 6 for inserting into the hitch of the ATV 2. The auger-holder 1 may include an assistive means 45 for moving the secondary frame 20 in vertical relation to the primary frame 10. It is to be understood that the assistive means 45 may be mounted on the primary frame 10 or the secondary frame 20 and may include, but is not limited to a spring, motor, hydraulic, gear, pulley, or the like. The assistive means 45 is simply affixed to the primary frame 10 or to the secondary frame 20 such that by its operation, the secondary frame 20 moves with respect to the primary frame 10. That is, as is well known to those skilled in the art, since the secondary frame 20 is slidable on the primary frame 10 as has been described creating a mechanical link between the two frames by way of the assistive means 45 and actuating the assistive means 45 will result in movement of the secondary frame 20 with respect to the primary frame 10 in a manner suitable for bringing the auger in contact with the underlying surface.

Figure 5:
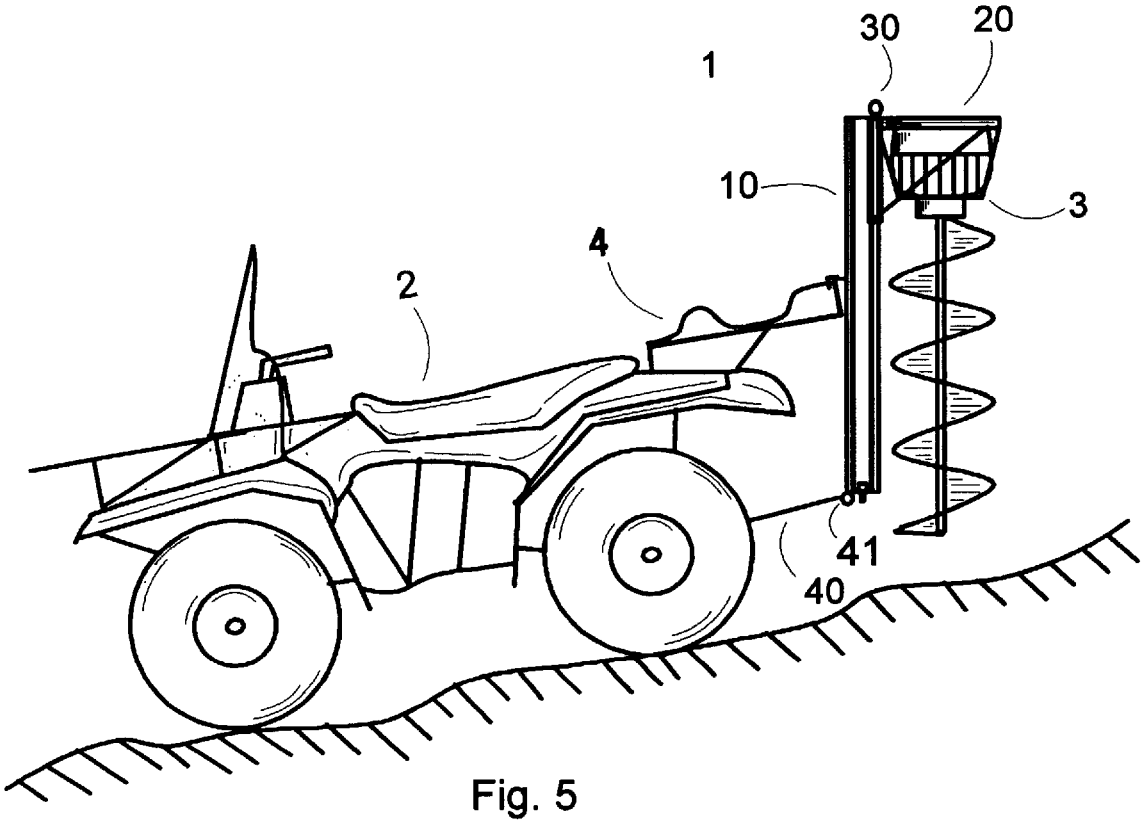
FIG. 5 is an expanded view of an alternative design including a hinged connector for securing the primary frame at an angle with respect to the ATV.
Figure 5A:
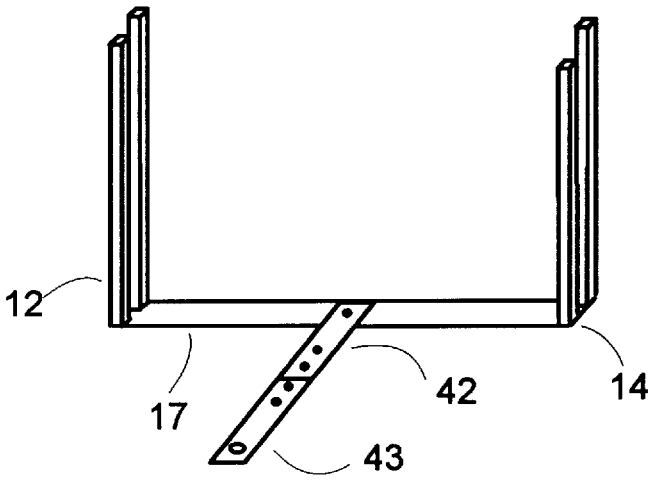
FIG. 5*a* is a three-dimensional view showing an alternative attachment means for securing the primary frame at an angle with respect to the ATV.

As shown in FIGS. 5 and 5*a,* the hitch mount 40 may further include a hinge 41 to allow the auger-holder 1 to be angularly mounted in relation to the underlying terrain. Alternatively, the hitch mount 40 may be two pieces of metal 42 and 43 with sets of holes to make the hitch mount 40 adjustable in length in order to accommodate for the angular mounting. The two pieces may be secured together by a bolt, pin, or the like.

The preferred embodiment of the present invention has been described herein. Further modification of the invention herein disclosed will occur to those skilled in the respective arts and all such modifications are deemed to be within the scope of the invention as defined by the appended claims.

What is claimed is:

1. An auger-holder for removably securing a portable auger to a vehicle, said auger-holder comprising:

a) a primary frame;

b) attachment means for securing said primary frame to said vehicle; and c) a secondary frame adjustably engageable with said primary frame such that a position of said secondary frame may be adjusted with respect to a fixed position of said primary frame, wherein said secondary frame is designed to receive a portable auger, and wherein said secondary frame may be of adjustable width to accept auger handles of differing dimensions.

2. The auger-holder as claimed in claim 1 wherein said primary frame is of adjustable width.

3. The auger-holder as claimed in claim 1 wherein said primary frame includes an assistive means for moving said secondary frame in vertical relation to said primary frame.

4. The auger-holder as claimed in claim 1 wherein said primary frame further includes a support that is adaptable to be secured to various types of racks or mounts of common commercial vehicles.

5. The auger-holder as claimed in claim 1 wherein said secondary frame includes an assistive means for moving said secondary frame in vertical relation to said primary frame.

6. The auger-holder as claimed in claim 1 wherein said attachment means further includes a hinge means for angularly alignment of said primary frame with underlying terrain.

7. The auger-holder as claimed in claim 6 wherein said attachment means is adaptable to various vehicle mounts.

8. The auger-holder as claimed in claim 7 wherein said attachment means is of adjustable length to allow for angular displacement of said primary frame in relation to underlying terrain.

9. The auger-holder as claimed in claim 1 wherein said primary frame further includes a locking means for securing said secondary frame in vertical relation to said primary frame.

10. An auger-holder for securing a portable auger to an all-terrain vehicle, said auger-holder comprising:

a) a primary frame;

b) attachment means for securing said primary frame to said vehicle; and c) a secondary frame having slidable sleeves engageable with said primary frame such that a width of said secondary frame may be adjusted, said secondary frame being moveable with respect to a fixed position of said primary frame, wherein said secondary frame includes a first auger arm support and a second auger arm support, wherein said first auger arm support and said second auger arm support are designed to receive and capture therein handles of a portable auger, said secondary frame further including fastening means to prevent the handles of the auger from sliding out of one or both of said first auger arm support and said second auger arm support.

11. The auger-holder as claimed in claim 10 wherein said primary frame further includes a support that is adaptable to be secured to various types of racks or mounts of common commercial vehicles.

12. The auger-holder as claimed in claim 10 wherein said attachment means further includes a hinge means for angularly adjusting alignment of said primary frame with underlying terrain.

13. An auger-holder for securing an auger to an all-terrain vehicle, said auger-holder comprising:

a) a primary frame including a plurality of adjustable horizontal supports;

b) a secondary frame of adjustable width and engageable with said primary frame such that said secondary frame is movable with respect to a fixed position of said primary frame, wherein said secondary frame includes at least two auger arm supports for securing an auger handle therebetween, and at least one fastening means for securing said auger handle within said auger arm supports;

c) an assistive means for moving said secondary frame in vertical relation to said primary frame;

d) a locking means for securing said secondary frame in vertical relation to said primary frame; and e) an adjustable attachment means for securing said primary frame to said vehicle, said attachment means including a hinge means for adjusting the angle of said primary frame in relation to the underlying terrain.

* * * * *